US006694558B2

(12) United States Patent
Ping

(10) Patent No.: US 6,694,558 B2
(45) Date of Patent: Feb. 24, 2004

(54) FOLDABLE HAND TOOL

(75) Inventor: Qiu Jian Ping, Hangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 0 days.

(21) Appl. No.: 10/357,237

(22) Filed: Feb. 5, 2003

(65) Prior Publication Data

US 2003/0110571 A1 Jun. 19, 2003

Related U.S. Application Data

(63) Continuation of application No. 09/594,018, filed on Jun. 15, 2000, now abandoned.

(51) Int. Cl.[7] ..... B25B 7/22
(52) U.S. Cl. ..... 7/128; 81/427.5
(58) Field of Search ..... 7/125, 127, 128, 7/118; 81/427.5

(56) References Cited

U.S. PATENT DOCUMENTS

| | | | |
|---|---|---|---|
| 154,750 | A | 9/1874 | Flack |
| 164,750 | A | 6/1875 | Meyer |
| 237,138 | A | 2/1881 | Slayton |
| 266,073 | A | 1/1882 | Augstin |
| 295,885 | A | 3/1884 | Pullman |
| 310,439 | A | 1/1885 | Kamak |
| 337,858 | A | 3/1886 | Neuhaus |
| 358,312 | A | 2/1887 | Weck |
| 445,509 | A | 1/1891 | Thayer |
| 464,405 | A | 12/1891 | Widman |
| 542,601 | A | 7/1895 | Bayer |
| 580,235 | A | 4/1897 | Strum |
| 589,392 | A | 7/1897 | Kelar |
| 592,766 | A | 11/1897 | Effinger et al. |
| 596,096 | A | 12/1897 | Watts |
| 614,537 | A | 11/1898 | Dahlquist |
| 649,334 | A | 5/1900 | Meloos |
| 662,005 | A | 11/1900 | Lewis |
| 696,995 | A | 4/1902 | Moser |
| 762,725 | A | 6/1904 | Kaufmann |
| 790,432 | A | 5/1905 | Heilrath |
| 857,459 | A | 6/1907 | Kendrickson |

(List continued on next page.)

FOREIGN PATENT DOCUMENTS

| | | |
|---|---|---|
| CH | 277412 | 11/1951 |
| DE | 29556 | 4/1884 |
| DE | 30788 | 3/1885 |

(List continued on next page.)

*Primary Examiner*—James G. Smith
(74) *Attorney, Agent, or Firm*—Joseph J. Previto

(57) ABSTRACT

A foldable tool having a pair of jaws pivoted to each other on a pivot pin, each jaw having a head and a shank, a spring mounted between the shanks of the jaws, a hollow handle pivotally mounted at one end to each of the shanks and foldable relative to the jaws. The hollow handle having a plurality of auxiliary tools pivotally mounted therewithin, the spring adapted to keep the jaws in a partially open position.

1 Claim, 10 Drawing Sheets

U.S. PATENT DOCUMENTS

| | | | |
|---|---|---|---|
| 858,003 | A | 6/1907 | Klever |
| 881,294 | A | 3/1908 | Billings |
| 896,746 | A | 8/1908 | Mc Carty |
| 948,231 | A | 2/1910 | Libby |
| 988,068 | A | 3/1911 | Beardsley et al. |
| 1,174,132 | A | 3/1916 | Dragun |
| 1,184,746 | A | 5/1916 | Hanson |
| 1,187,842 | A | 6/1916 | Kaas |
| 1,194,296 | A | 8/1916 | Jones et al. |
| 1,334,425 | A | 3/1920 | Wernimont |
| 1,370,906 | A | 3/1921 | Newton |
| 1,461,270 | A | 7/1923 | Garrison |
| 1,467,661 | A | 9/1923 | Undy |
| 1,472,826 | A | 11/1923 | Champlin |
| 1,474,592 | A | 11/1923 | Jacoby |
| 1,486,725 | A | 3/1924 | Brown |
| 1,511,340 | A | 10/1924 | Jackson |
| 1,524,694 | A | 2/1925 | Di Maio |
| 1,551,328 | A | 8/1925 | Perry |
| 1,561,833 | A | 11/1925 | Cruickshank |
| 1,561,993 | A | 11/1925 | Nielsen |
| 1,619,181 | A | 3/1927 | Beretz |
| 1,828,121 | A | 10/1931 | Adam |
| 2,057,201 | A | 10/1936 | Mc Cluskey |
| D112,590 | S | 12/1938 | Mac Pherson |
| D137,408 | S | 3/1944 | Frisk |
| D149,934 | S | 6/1948 | Cobb |
| 2,514,130 | A | 7/1950 | Jones |
| 2,561,682 | A | 7/1951 | Barnett |
| 2,575,652 | A | 11/1951 | Bovee |
| 2,606,471 | A | 8/1952 | Kollweck |
| 2,641,149 | A | 6/1953 | Petersen |
| 2,714,249 | A | 8/1955 | Clark et al. |
| 2,747,446 | A | 5/1956 | Eder |
| 2,779,098 | A | 1/1957 | Pocoski et al. |
| 2,814,108 | A | 11/1957 | Passott |
| 3,044,081 | A | 7/1962 | Robingson, Jr. |
| 3,364,508 | A | 1/1968 | Garrett |
| 3,798,687 | A | 3/1974 | Stevens |
| 3,858,258 | A | 1/1975 | Stevens |
| 3,947,905 | A | 4/1976 | Neff |
| 4,208,749 | A | 6/1980 | Hermann et al. |
| 4,238,862 | A | 12/1980 | Leatherman |
| 4,297,756 | A | 11/1981 | Lance |
| 4,330,937 | A | 5/1982 | Cope |
| 4,347,665 | A | 9/1982 | Glesser |
| 4,364,174 | A | 12/1982 | De Asis |
| 4,502,220 | A | 3/1985 | Aoki |
| 4,512,051 | A | 4/1985 | Magan |
| 4,555,822 | A | 12/1985 | Miceli |
| 4,563,833 | A | 1/1986 | Aucoin |
| D286,501 | S | 11/1986 | Magan |
| 4,648,145 | A | 3/1987 | Miceli |
| 4,669,140 | A | 6/1987 | Miceli |
| 4,744,272 | A | 5/1988 | Leatherman |
| 4,805,303 | A | 2/1989 | Gibbs |
| 4,888,869 | A | 12/1989 | Leatherman |
| 4,896,424 | A | 1/1990 | Walker |
| 4,942,637 | A | 7/1990 | Yeang Yai |
| 4,995,128 | A | 2/1991 | Montgomery et al. |
| 5,014,379 | A | 5/1991 | Hull et al. |
| 5,029,355 | A | 7/1991 | Thai |
| 5,044,079 | A | 9/1991 | Gibbs |
| 5,062,173 | A | 11/1991 | Collins et al. |
| 5,074,046 | A | 12/1991 | Kolesky |
| 5,119,520 | A | 6/1992 | Finn |
| D327,826 | S | 7/1992 | Neff |
| 5,142,721 | A | 9/1992 | Sessions et al. |
| 5,157,996 | A | 10/1992 | Keyvani |
| 5,207,012 | A | 5/1993 | Lael |
| 5,212,844 | A | 5/1993 | Sessions et al. |
| D338,386 | S | 8/1993 | Frazer |
| 5,267,366 | A | 12/1993 | Frazer |
| 5,320,004 | A | 6/1994 | Hsiao |
| D356,019 | S | 3/1995 | Sakai |
| D365,266 | S | 12/1995 | Hasegawa |
| 5,491,856 | A | 2/1996 | Legg |
| D367,807 | S | 3/1996 | Hung |
| 5,497,522 | A | 3/1996 | Chen |
| D368,634 | S | 4/1996 | Frazer |
| D371,498 | S | 7/1996 | Lai |
| 5,537,750 | A | 7/1996 | Seber et al. |
| D382,182 | S | 8/1997 | Seber |
| D384,872 | S | 10/1997 | Yeh |
| D385,170 | S | 10/1997 | Rivera |
| 5,697,114 | A | 12/1997 | Mc Intosh et al. |
| 5,745,997 | A | 5/1998 | Berg et al. |
| 5,765,247 | A | 6/1998 | Seber et al. |
| 5,809,853 | A | 9/1998 | Hudson |
| D407,286 | S | 3/1999 | Seber et al. |
| D407,287 | S | 3/1999 | Seber et al. |
| D407,616 | S | 4/1999 | Seber |
| D407,621 | S | 4/1999 | Koon |
| D410,833 | S | 6/1999 | Hasegawa |
| D414,092 | S | 9/1999 | Chang |
| 5,964,131 | A | 10/1999 | Seber et al. |
| D416,184 | S | 11/1999 | Gathmann |
| D416,186 | S | 11/1999 | Balolia |
| 5,979,059 | A | 11/1999 | Leatherman |
| 5,979,959 | A | 11/1999 | Rivera |
| D417,380 | S | 12/1999 | Kayson |
| 5,996,451 | A | 12/1999 | Seber et al. |
| 6,006,385 | A | 12/1999 | Kershaw et al. |
| D419,849 | S | 2/2000 | Kayson |
| 6,047,426 | A | 4/2000 | Mc Intosh et al. |
| D440,846 | S | 4/2001 | Saunders |
| D442,841 | S | 5/2001 | Balolia |
| 6,318,218 | B1 | 11/2001 | Anderson |
| D458,527 | S | 6/2002 | Ping |
| D469,328 | S | 1/2003 | Ping |

FOREIGN PATENT DOCUMENTS

| | | |
|---|---|---|
| DE | 145784 | 7/1902 |
| DE | 2322229 | 5/1974 |
| DE | G 91 03 496.5 | 8/1991 |
| EP | 971001156.5 | 7/1997 |
| FR | 409943 | 5/1910 |
| FR | 2308470 | 11/1976 |
| GB | 5375 | 11/1882 |
| GB | 21369 | 11/1895 |
| GB | 17248 | 6/1896 |
| GB | 20299 | 11/1902 |
| GB | 15859 | 11/1904 |
| GB | 13254 | 9/1905 |
| GB | 14268 | 6/1907 |
| GB | 186520 | 10/1922 |
| GB | 403769 | 1/1934 |
| IT | 521555 | 3/1955 |
| RU | 1002145 | 3/1983 |

FOLDABLE HAND TOOL

This application is a continuation of United States Patent Application Serial No. 09/594,018 filed June 15, 2000, abandoned.

BACKGROUND

The present invention relates to hand tools and more particularly to foldable hand tools such as foldable wrenches, pliers, etc.

Foldable hand tools have been in use for a number of years. In general they comprise two jaws pivoted together from which handles extend rearwardly and are pivotally mounted thereon. The handles are foldable relative to the jaws from an open to a closed position. In some such hand tools, the handles are substantially hollow in order to permit the jaws to be folded therewithin. The handles may also have auxiliary tools pivotally mounted thereon which are closeable within the hollow handles. Many of these tools comprise complicated mechanisms for opening and closing them as well as for keeping them in the open or closed positions. Many of them are expensive to manufacture and assemble and are complex to use.

OBJECTS

This present invention overcomes these defects and has to one of its objects the provision of an improved foldable hand tool which is simple to use.

Another object of the present invention is the provision of an improved foldable hand tool in which the jaws and handles can be easily folded and unfolded relative to each other.

Another object of the present invention is the provision of an improved folded hand tool in which auxiliary tools are pivotally mounted in the handles and which may be easily opened and closed relative to the handles Another object of the present invention is the provision of an improved foldable hand tool which is simple and inexpensive to manufacture and assemble.

Other and further objects of the invention will be obvious upon an understanding of the illustrative embodiment about to be described, or will be indicated in the appended claims and various advantages not referred to herein will occur to one skilled in the art upon employment of the invention in practice.

DRAWINGS

A preferred embodiment of the invention has been chosen for the purposes of illustration and description and is shown in the accompanying drawings forming a part of the specification, wherein:

FIG. 1 is a plan view of a hand tool made in accordance with the present invention, showing the tool in its unfolded position.

FIG. 2. is a sectional view taken along line 2—2. of FIG. 1.

FIG. 3. is a sectional view taken along line 3—3 of FIG. 1

DESCRIPTION

Figure 1:
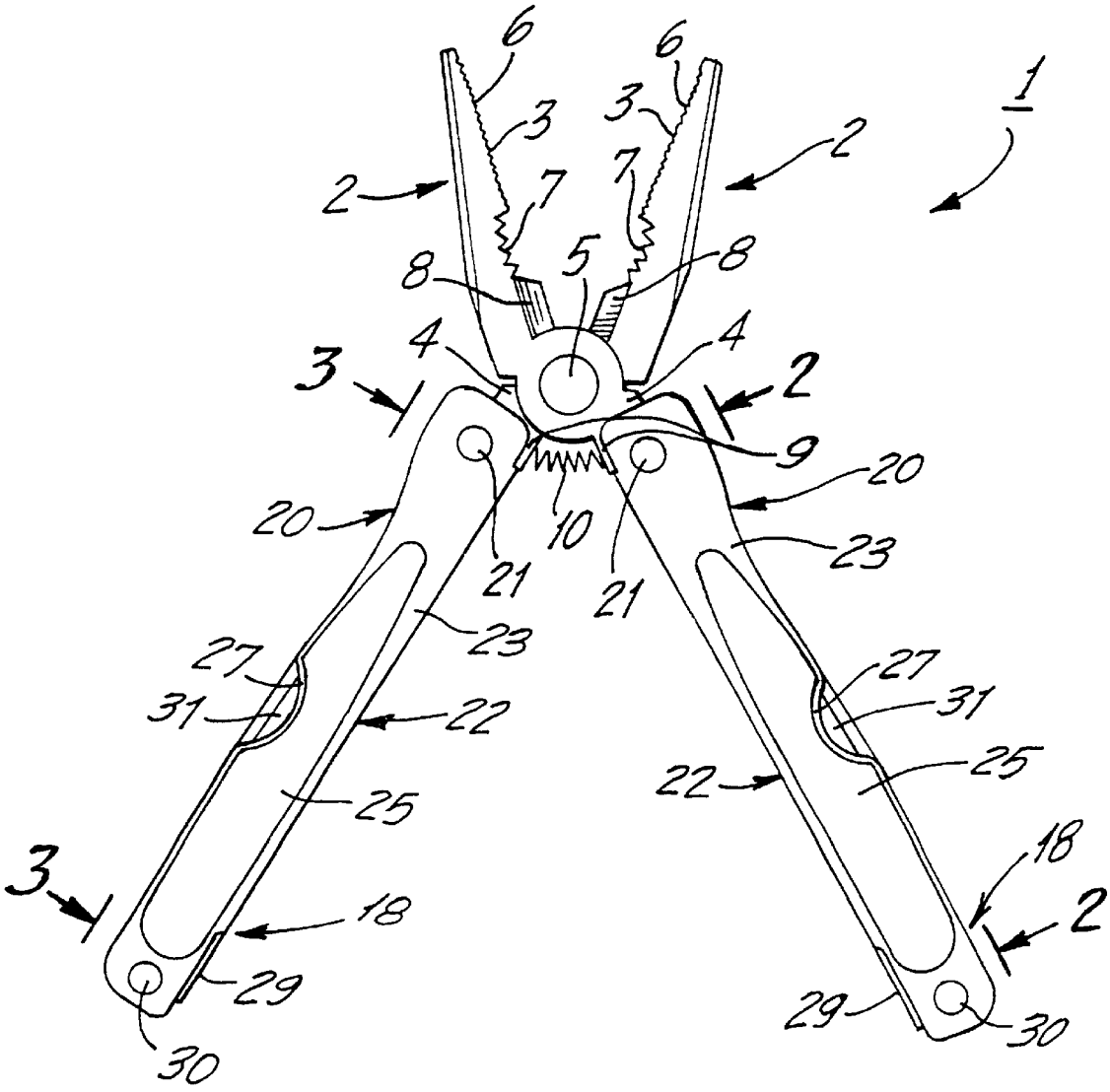
Figure 2:
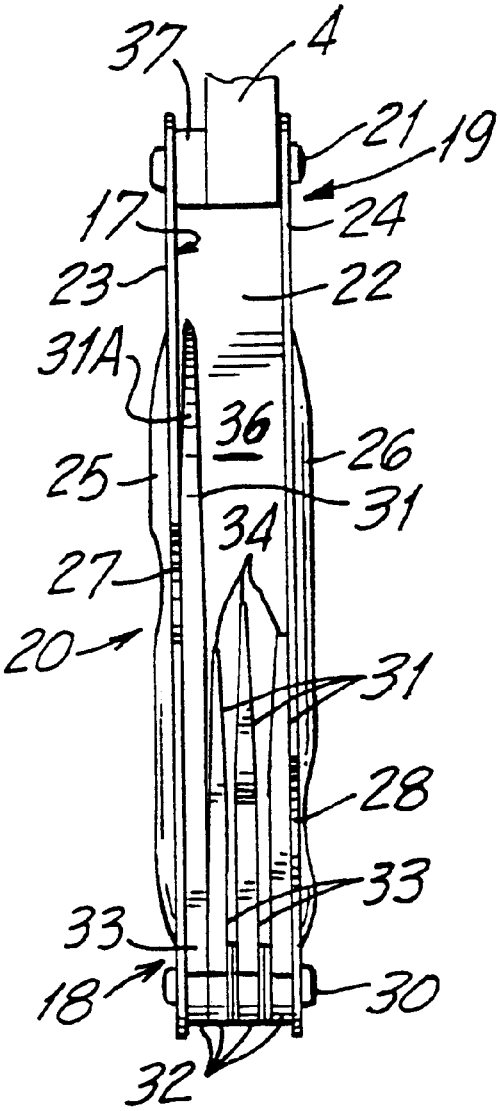
Figure 3:
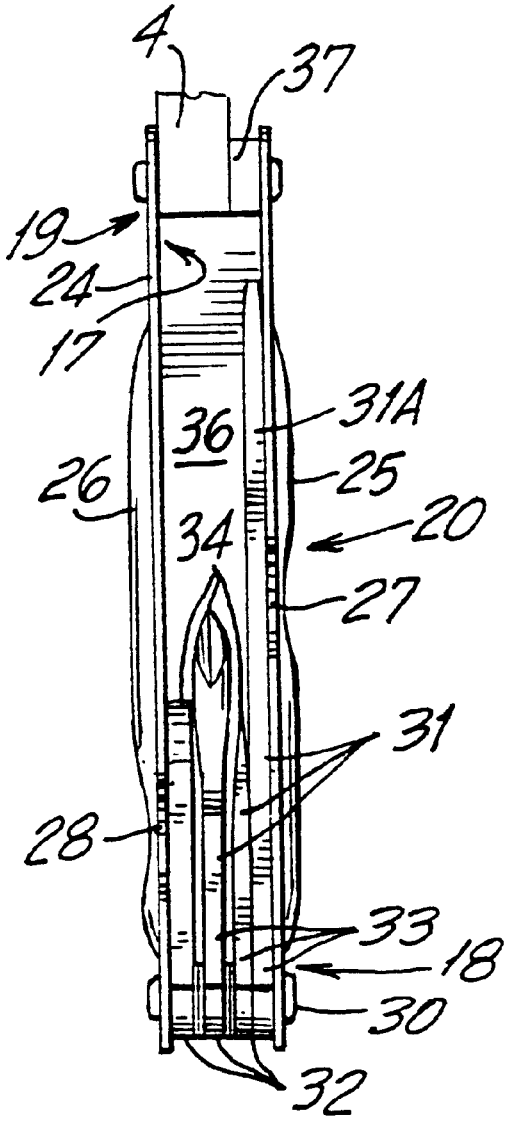
Figures 4, 4A, 4B, 4C, 4D:
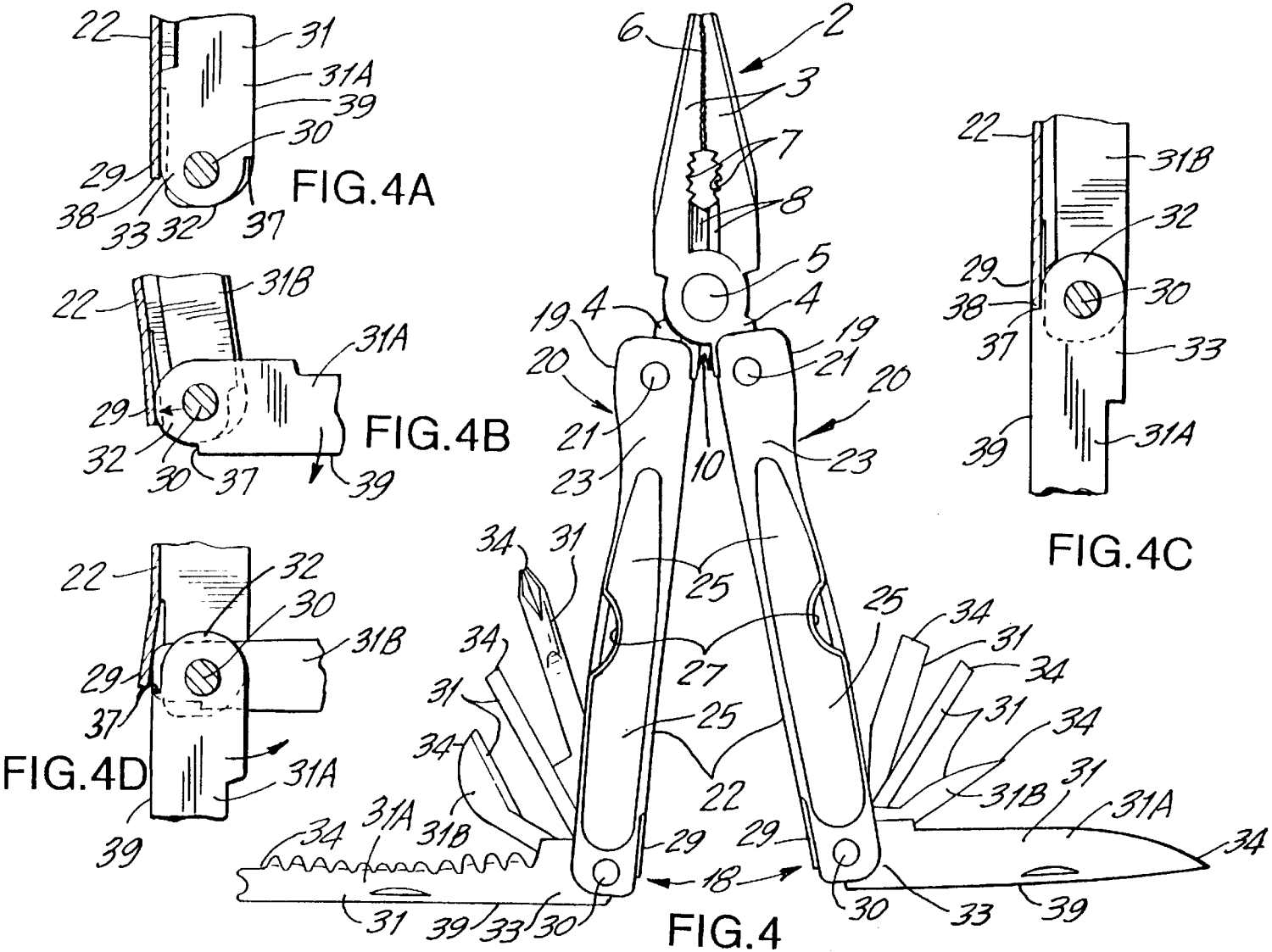
FIG. 4 is a plan view showing the tool in its unfolded position with its auxiliary tools shown in their partly open position.
FIG. 4A is a detail view, partly in section, showing an auxiliary tool in its closed position within a handle.
FIG. 4B is a detail view, similar to FIG. 4A, showing the auxiliary tool in a partially opened position.
FIG. 4C is a detail view, similar to FIG. 4A, showing the auxiliary tool in its fully opened position.
FIG. 4D is a detail view, similar to FIG. 4A, showing the manner in which the auxiliary tool may be moved back to a closed position within the handle.

Referring to the drawings, and more particularly to the embodiment of the invention shown in FIGS. 1–8, the tool 1 of the present invention comprises a pair of jaws 2 each having a head 3 and a shank 4 and pivoted to each other between head 3 and shank 4 on pivot pin 5. The jaws 2 pivot from an open position to a closed position around the pivot pin 5. Connected in any well known manner to the inner surface 9 of each shank 4 is a spring 10 which may keep the jaws 2 in a partially open position, if desired. Preferably, the spring 10 is shown as being a coil spring having each end mounted to opposed shank surfaces 9. This permits the spring 10 to stretch when the tool is folded (FIG. 5) and return to its original shape and effectiveness when the tool is unfolded (FIG. 1). However, it will be understood that other springs may be used, if desired, without departing from the invention. In the drawings, the jaws 2 are shown as being substantially identical to each other with each head 3 having teeth 6 in a straight configuration, teeth 7 in a curved configuration and cutter blades 8. However, it will be understood that the tool of the present invention may have pivoted members other than the jaws 2 shown in the drawing, such as scissors, blades and the like, without departing from the invention.

Extending rearwardly from each shank 4 is a hollow handle 20 which is pivotedly mounted at its inner end 19 on pivot pin 21 and is moveable from a folded position to an unfolded position. Each handle 20 comprises a bottom wall 22 and a pair of upstanding side walls 23 and 24 at right angles with and connected to said bottom wall 22. The top 17 of each hollow handle 20 opposite bottom wall 22 is substantially open. Finger pads or grips 25 and 26 (which may also contain graphics and/or other data) may also be provided on the side walls 23 and 24, respectively, and finger notches 27 and 28 may be formed in the side walls 23 and 24, respectively, and finger notches 27 and 28 may be formed in the side walls 23 and 24, respectively.

At the outer end 18 of each handle 20 and opposite the pivot pin 21, a pivot pin 30 is provided on which a plurality of auxiliary tools 31 are pivotally mounted. The auxiliary tools 31 may comprise knives, saws, screwdrivers, scissors, and the like. The auxiliary tools 31 are individually pivotable from a closed position within the sidewalls 23–24 of the hollow handle 20 to an open position extending beyond the open top 17 of the hollow handle 20. These auxiliary tools 31 are positioned in side-by-side relationship between and within the side walls 23–24 of each handle 20. The inner end 19 of the hollow handles 20 has a space 36 devoid of any auxiliary tool 31 to receive and accommodate the jaws 2 when the tool is in its folded position. A spacer 37 may be provided around pivot 21 to keep the shanks 4 and the jaws 2 adjacent to one of the side walls (e.g. side wall 24) of the hollow handle 20 and on auxiliary tool (e.g. elongated auxiliary tool 31A) may lie along opposite side wall 23 to form the space 36 so that, when fully folded, the jaws 2 will fit into this space 36 and will lie between side wall 24 and elongated auxiliary tool 31A. It will be understood that auxiliary tool 31A need not be an elongated auxiliary tool, without departing from the invention.

The rear end of the bottom wall 22 of each hollow handle 20 has slits 40 where the bottom wall 22 and side walls 23–24 meet to form a lock spring 29 as an extension of and at same plane as bottom wall 22 with its end edge 38 forming a locking edge. Each auxiliary tool 31 has an active front end 34 and a rear end 33 mounted on pivot pin 30. The rear end 33 of each auxiliary tool 31 has a curved cam surface 32 which has an outer radius, or at least a portion thereof, which is greater than the distance between lock spring 29 and pivot 30. The rear end 33 of the auxiliary tools 31 may also have a locking notch 37 in the form of a edge (in this embodiment) along its outer edge 39. As shown in detail in FIGS. 4A to 4D, when an auxiliary tool 31 is to be opened (e.g. auxiliary tool 31A) it is moved out of the hollow handle 20 around the pivot pin 30. Finger notch 27 may be used to grasp the auxiliary tool 31A. The cam surface 32 of the auxiliary tool 31A contacts and exerts outward pressure on the lock spring 29 and moves the lock spring 29 away from the plane of the bottom wall 22. When the auxiliary tool 31A has been fully opened, its lock edge 38 snaps into the lock notch 37 in the auxiliary tool 31A to lock the auxiliary tool 31A in place and prevent it from any pivotal movement (accidental or otherwise) around the pivot pin 30 so that it cannot be closed.

When it is desired to close the auxiliary tool 31A, it is necessary to first partially move one of the other auxiliary tools 31 (e.g. tool 31B) to at least a partially open position so that the rear cam surface 32 of that auxiliary tool 31B will contact and move the lock spring 29 away from the plane of the bottom wall 22 and its lock edge 38 out of the lock notch 37 in the first auxiliary tool 31A to release that tool and permit the auxiliary tool 31A to swing around the pivot pin 30 and be closed back into the hollow handle 20. Preferably, potentially dangerous auxiliary tools, such as knives and saws, should have this locking-unlocking feature, however if desired, it will be understood that all of the auxiliary tools 31 may have this locking-unlocking feature without departing from the invention.

Figure 5:
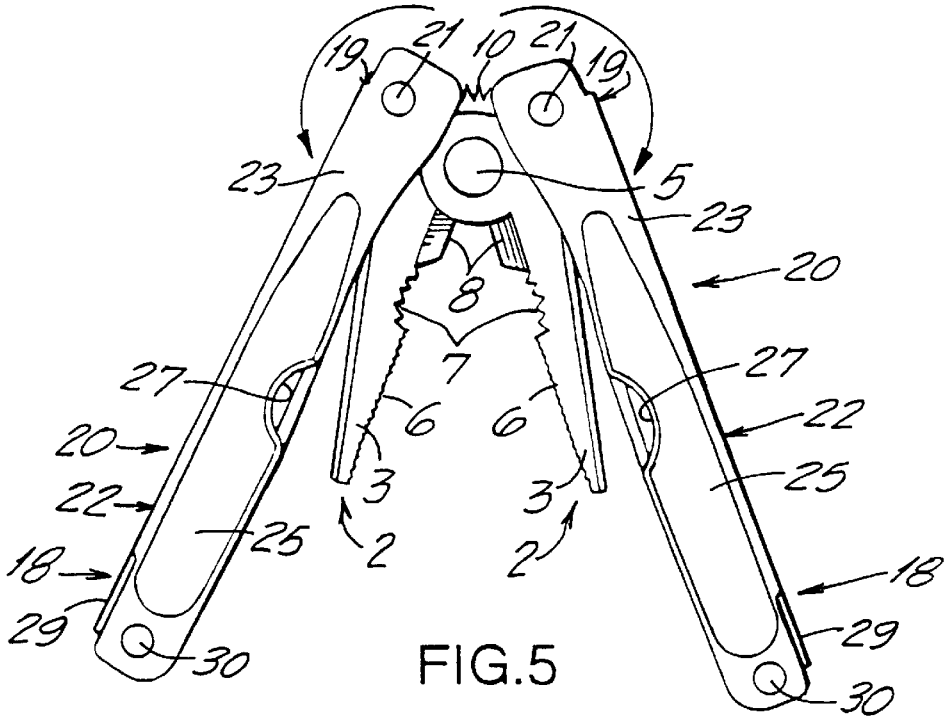
FIG. 5 is a plan view showing the tool in the process of being folded.
Figure 6:
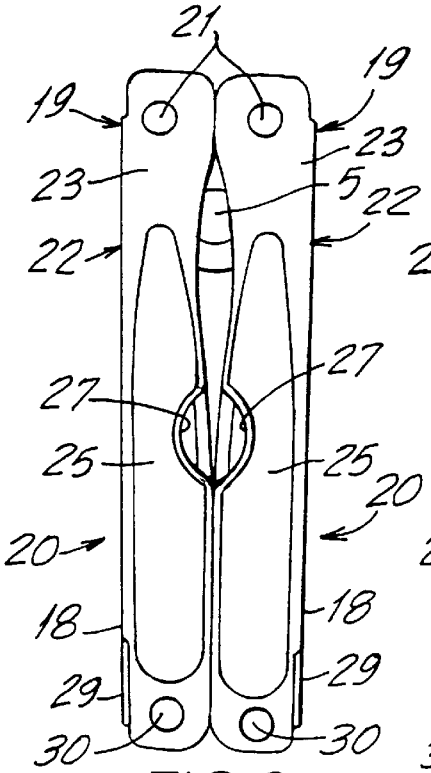
FIG. 6 is a side view showing one side the tool in the folded position.
Figure 7:
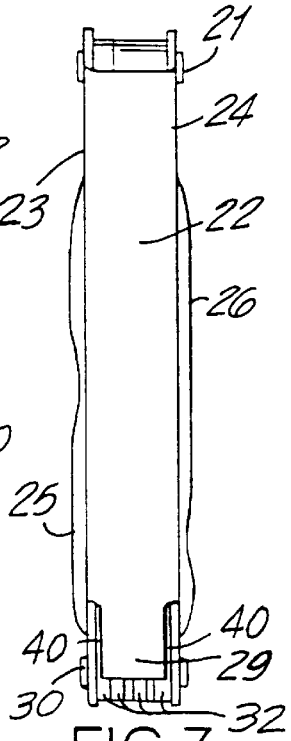
FIG. 7 is a edge view thereof.
Figure 8:
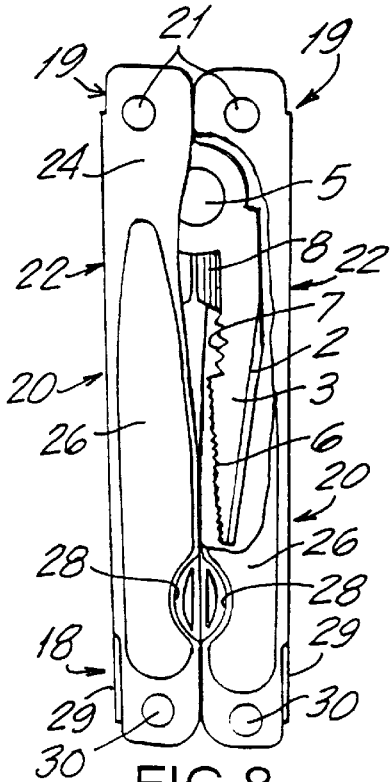
FIG. 8 is a side view, partially cut away, showing the other side of the hand tool in the folded position.
Figure 9:
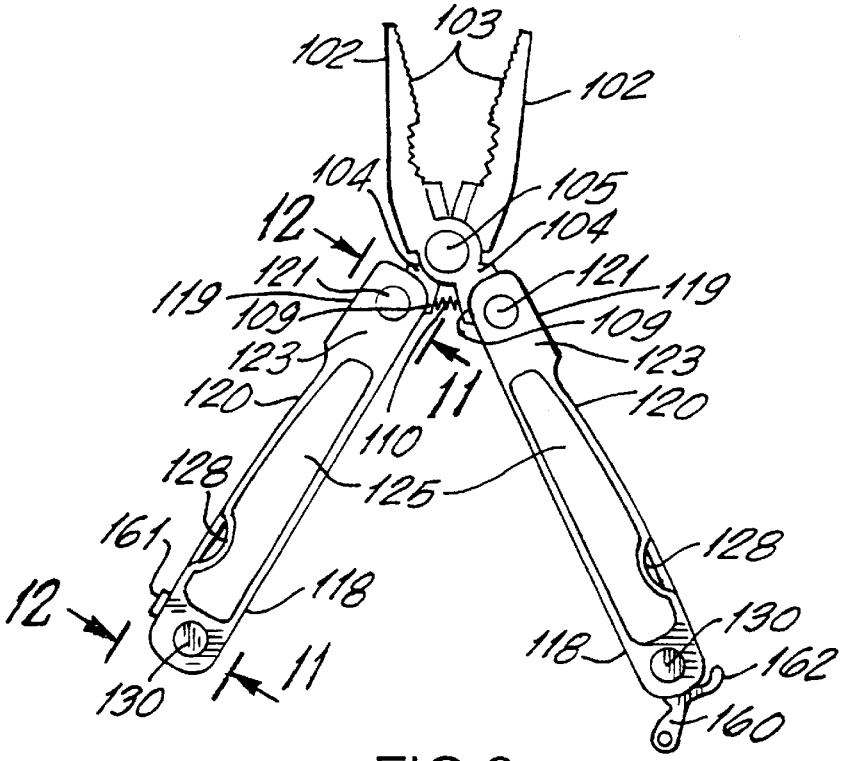
FIG. 9 is a plan view of another embodiment of the present invention showing one side of a tool in its unfolded position.
Figure 11:
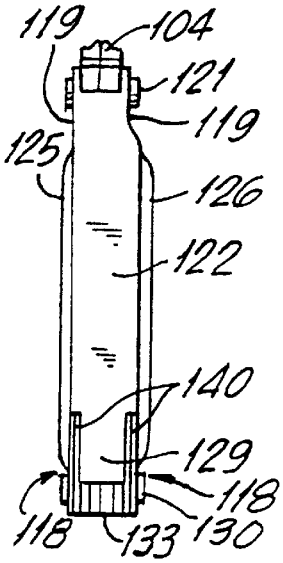
FIG. 11 is a sectional view taken along line 11—11 of FIG. 9.
Figure 10:
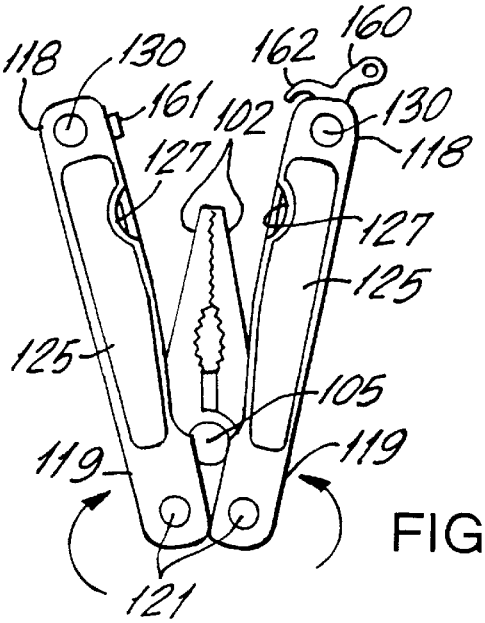
FIG. 10 is a plan view thereof showing the tool in the process of being folded.
Figure 12:
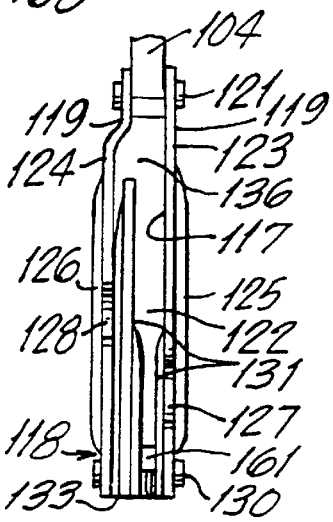
FIG. 12 is a sectional view taken along line 12—12 of FIG. 9
Figure 13:
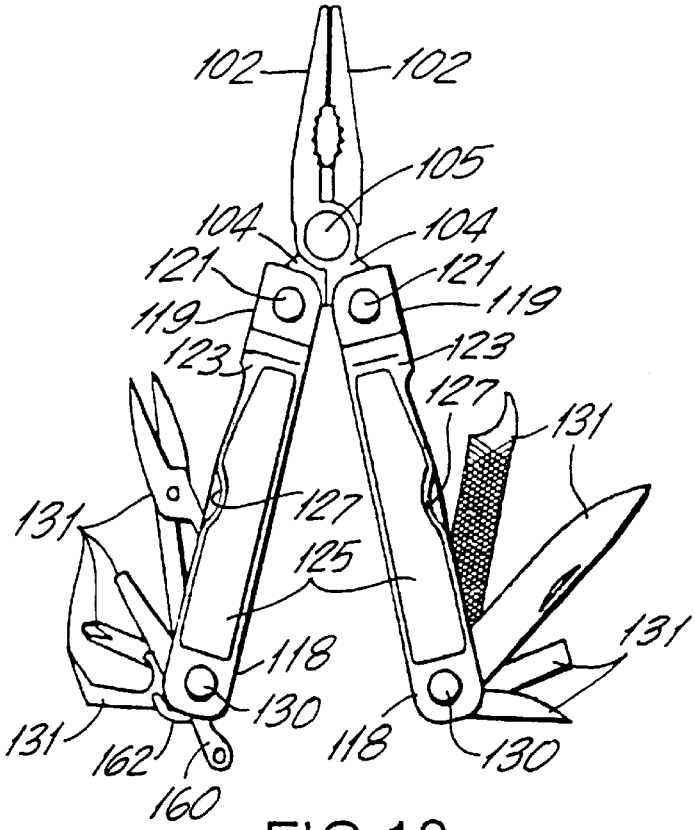
FIG. 13 is a plan view showing the other side of the unfolded tool with its auxiliary tools in partially open positions.
Figure 14:
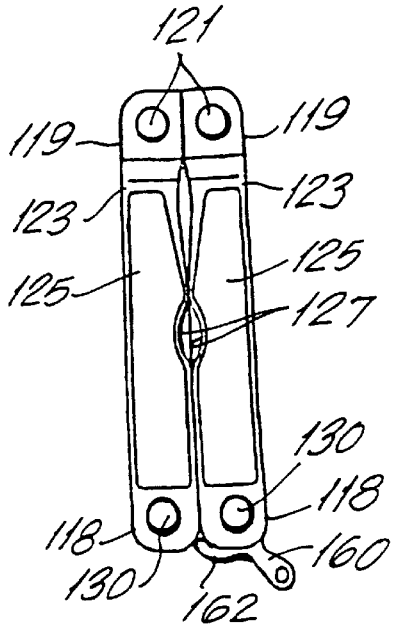
FIG. 14 is a plan view showing the tool in its folded position.
Figure 15:
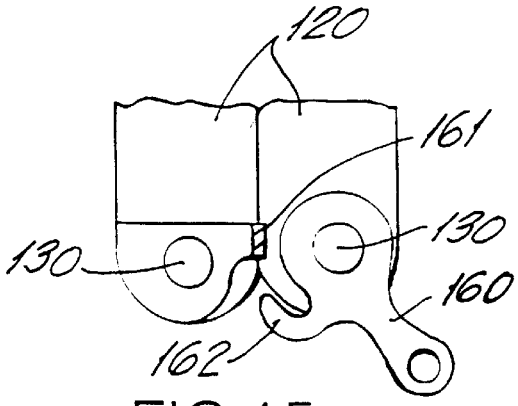
FIG. 15 is a detail view showing the locking mechanism for the folded tool in its unlocked condition.
Figure 16:
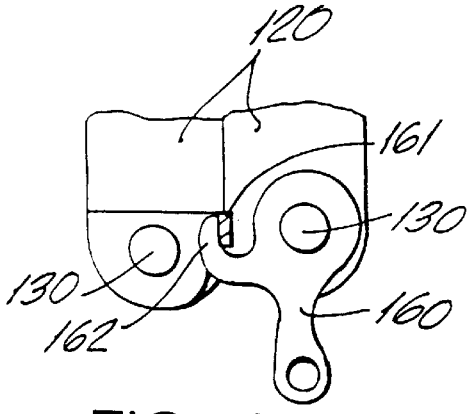
FIG. 16 is a detail view showing the locking mechanism in its locked condition.
Figure 17:
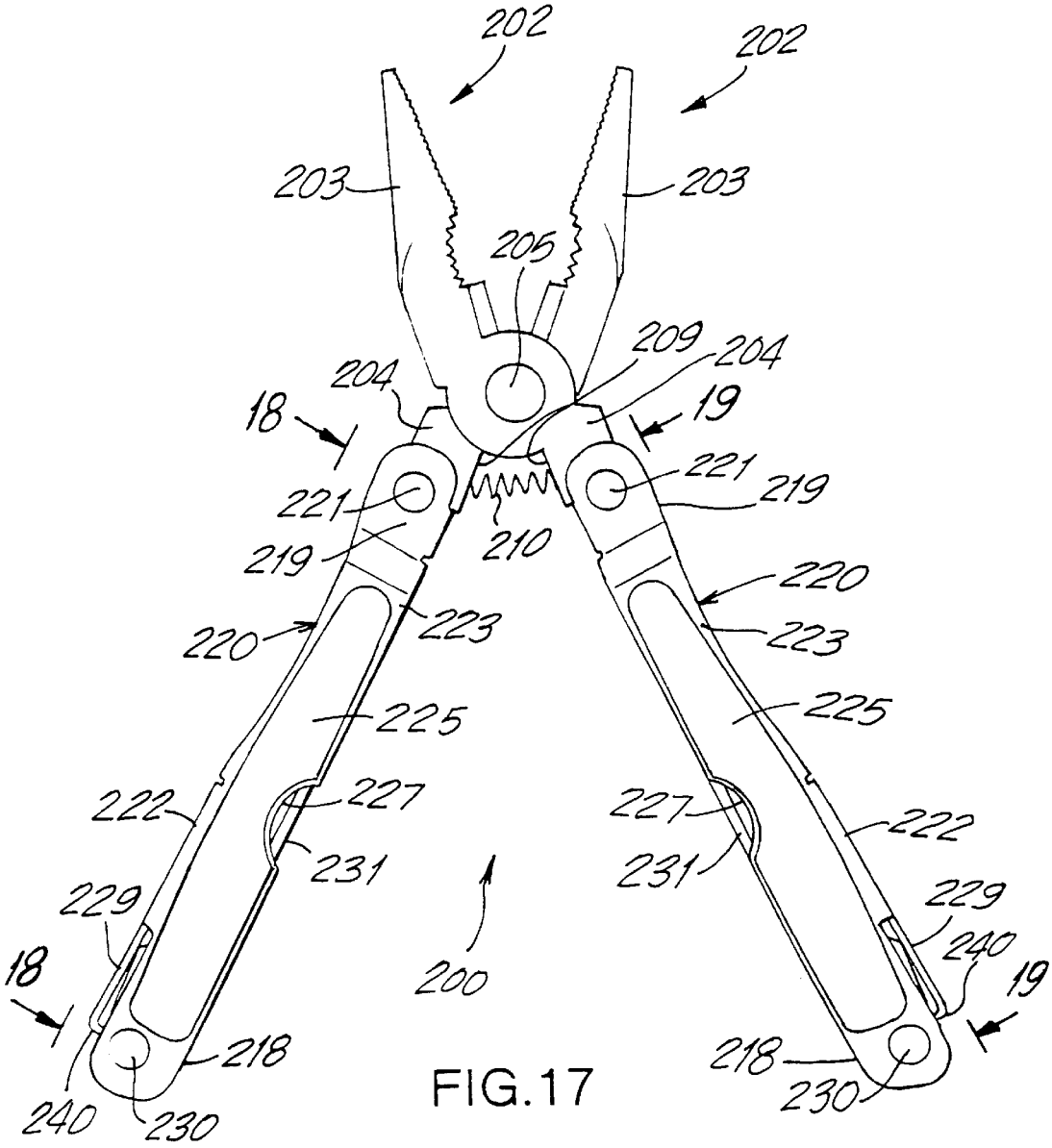
FIG. 17 is a plan view of another modification of the present invention showing the tool in its unfolded position.
Figure 18:
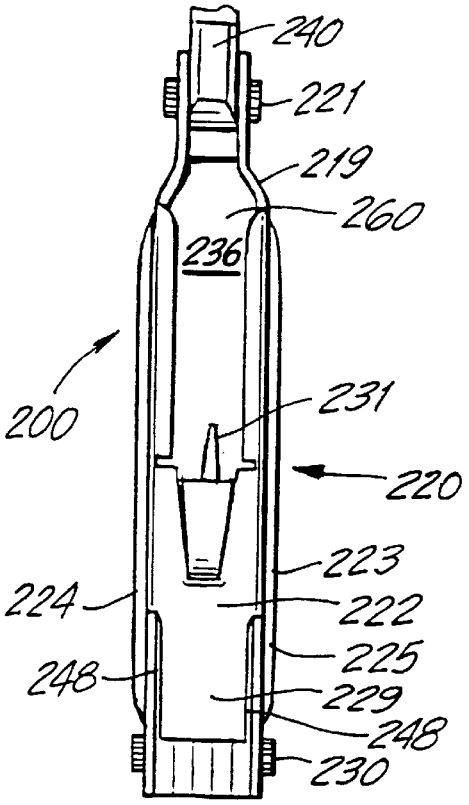
FIG. 18 is a sectional view taken along line 18—18 of FIG. 17.
Figure 19:
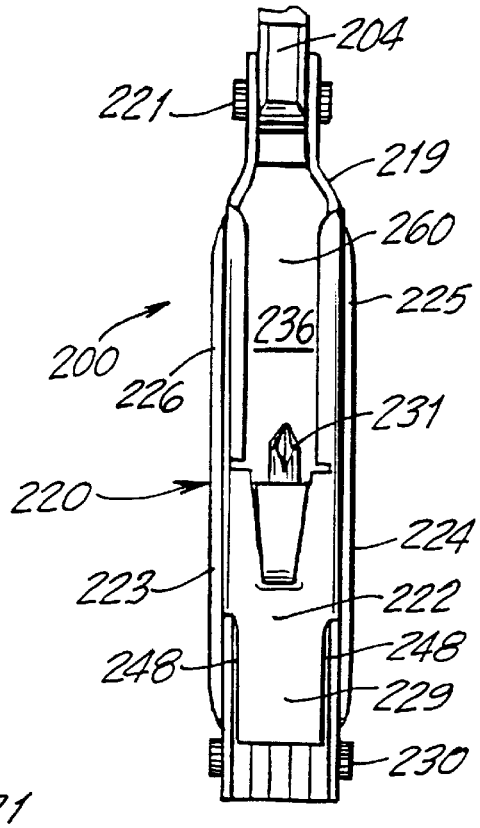
FIG. 19 is a sectional view taken along line 19—19 of FIG. 17.
Figure 20:
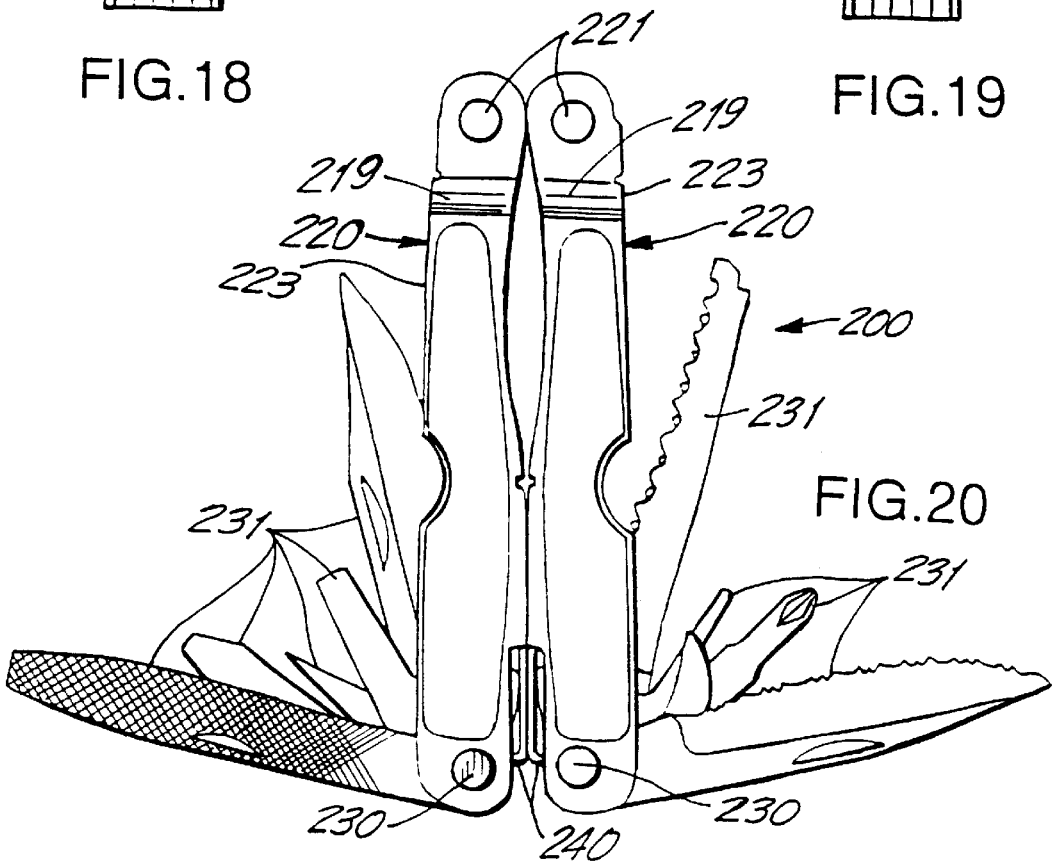
FIG. 20 is a plan view showing the tool in its folded position with its auxiliary tools in thier partially opened positions.
Figure 21:
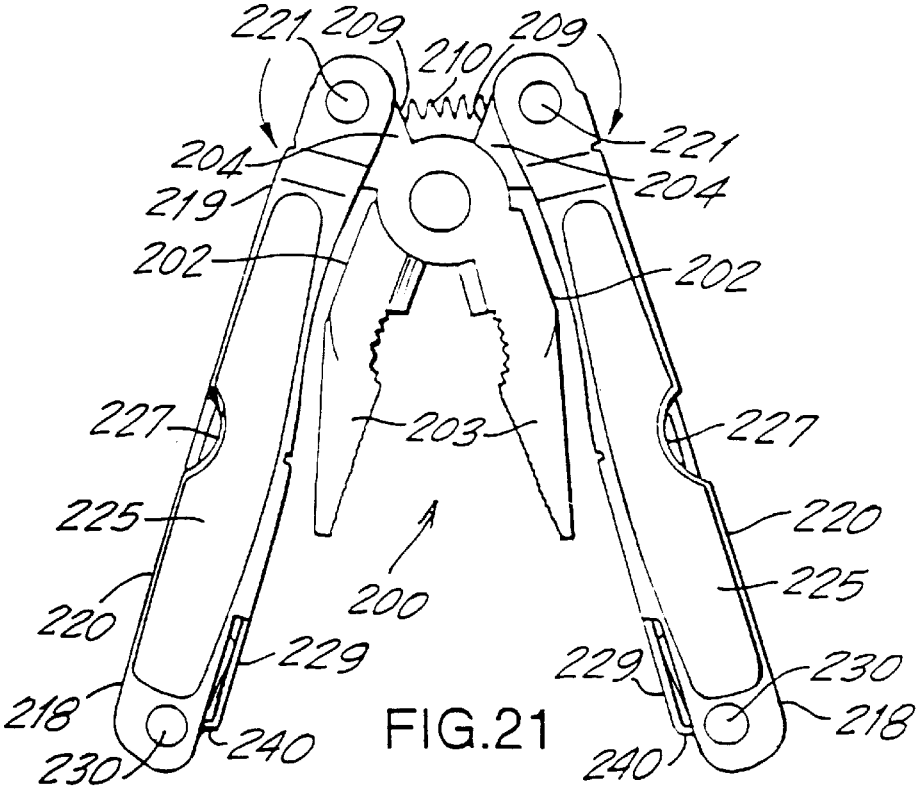
FIG. 21 is a plan view showing the tool in the process of being folded.
Figures 22, 23, 24:
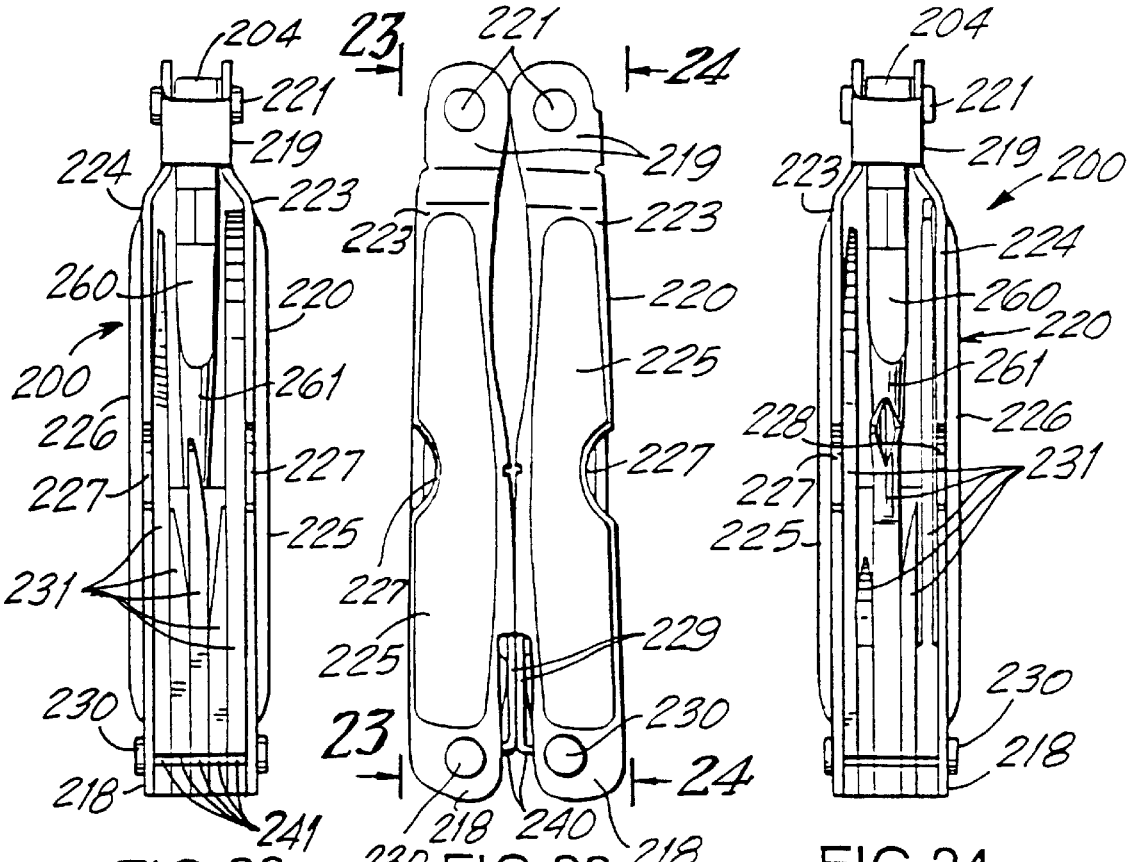
FIG. 22 is a side view thereof.
FIG. 23 is a sectional view taken along lines 23—23 FIG. 22.
FIG. 24 is a sectional view taken along lines 24—24 FIG. 22.

When it is desired to fold the tool 1, all of the auxiliary tools 31 are placed within the hollow handles 20 to a closed position and each of the hollow handles 20 is then folded around their pivots 21 so the jaws 2 will nest within hollow spaces 36 in the hollow handles 20 and keep them in a folded position (FIG. 5). The spring 10 will be stretched but will still return to its original position when the tool is unfolded (FIG. 1.). It will be seen that open top 17 of each handle will face outwardly when the tool is unfolded and will face each other when the tool is folded. Hence, the auxiliary tools 31 may be opened and used when the tool is in its unfolded position but when the tool is in its folded position, the auxiliary tools 31 will face each other and will be unable to be opened and used.

Referring the embodiment of the invention shown in FIGS. 9 to 16, the hand tool 100 is similar to the tool 1 shown and described in connection with the embodiment of FIGS. 1 to 8. A pair of jaws 102 are pivoted to each other at pivot pin 105 and each jaw 102 has a head 103 and a shank 104 with a spring 110 between the inner surfaces 109 of the shanks 104. Pivotally mounted to each shank 104 on pivot pin 121 at its inner end 119 is a hollow handle 120 which has a pair of side walls 123–124, a bottom wall 122 and an open top 117 opposite the bottom wall 122. Finger pads or grips 125–126 and finger notches 127–128 may also be provided on the side walls 123–124, respectively. The inner end 119 of each hollow handle 120 has a hollow space 136 within which the jaws 102 may lie when the tool 100 is folded. However, rather than using the spacer 36 of the FIGS. 1 to 8 embodiment to keep the jaws 102 to one side of the hollow handle 120 and within space 136, the side wall 123 at the inner end 119 of the handle 120 may be bent in toward the side wall 124. The bottom wall 122 at the outer end 118 of each hollow handle 120 opposite the pivot 121 is provided with a lock spring 129 formed by slits 140 therein. A plurality of auxiliary tools 131 are pivotally mounted on the pivot 130 at the outer end 118 of each hollow handle 120 and are adapted to be closed within each of the hollow handles 120. The lock spring 129 and the auxiliary tool locking and unlocking features (not shown) at the rear ends 133 of the auxiliary tools 131 are identical to that shown and described in FIGS. 4A to 4D in connection with the embodiment of FIGS. 1–8 and will not be further described in detail herein.

This embodiment is also provided with a locking assembly 160–162 for locking the two handles 120 together when the tool is folded so that there is no accidental opening of the tool 100. A hook 162 is pivotally mounted on the outer end 118 of one handle 120 and a locking bar 161 is mounted on the outer end 118 of the other handle. The locking hook 162 is adapted to hook onto the locking bar 161 in order to hook the two handles 120 together and keep them locked in the folded position. To unfold the handles 120, the locking hook 162 is unhooked from the locking bar 161. A eyelet 163 may also be provided to permit the tool to be hung on a key chain or similar article.

The manner of folding and unfolding the tool of this embodiment, as well as the manner of opening and closing the auxiliary tools 131 is identical to the manner of folding and unfolding the tool and opening and closing the auxiliary tools described in connection with embodiment of the invention shown and described in FIGS. 1–8 and will not be further described herein.

It will be noted that also in this embodiment when the tool is folded, the open top 117 of the handles and the auxiliary tools 131 therein face each other and cannot be used. However, when the tool is unfolded, the open top of the hollow handles 120 face away from each other in order to permit the auxiliary tools 33 therein to be opened and used.

Referring to the embodiment of the invention shown in FIGS. 17–26 a similar hand tool 200 is shown having jaws 202 pivotally mounted at pivot pin 205 each of which has a head 203 and a shank 204 with a spring 210 connected to and between the inner surfaces 209 of the shanks 204. Hollow handles 220 extend from the shanks 204 and have their inner ends 219 pivotally mounted on pivot pin 221 on each shank 204. The hollow handles 220 have a bottom wall 222 and upstanding side walls 223 and 224. The top 217 opposite the bottom wall 222 is open. Finger pads or grips 225–226 and finger notches 227–228 may also be provided on side walls 223–224, respectively. The hollow handles 220 have a pivot pin 230 at their outer ends 218 on which is pivotally mount a plurality of auxiliary tools 231. The bottom wall 222 has a an opening 260 therein to form a space 236 for the folded jaws 202. The bottom wall 222 also has a depressed tongue 261 to support the jaws 202 when in the folded position. The bottom wall 222 terminates in a leaf spring 229 at its outer end formed by slits 248 which has an end edge 238 in the form of a lock finger 240 extending from the leaf spring 229. It will be noted that the open top 217 of the handles 220 face inwardly toward each other when unfolded and face outwardly away from each other when the tool is folded so that the auxiliary tools 231 can be open and used while the entire tool is folded.

Somewhat similar to the auxiliary tool locking and unlocking features of the FIGS. 1–8 and 9–16 embodiments, the auxiliary tools 231 has a locking notch 237 in the form of a groove 241, as well as a rear cam surface 232. The distance between the rear cam surface 232 and the pivot pin 230 is greater than the distance between the lock spring 229 and the pivot pin 230 so that when the tool 231 is rotated around pivot pin 230 its cam surface 232 will strike and lift the lock spring 229 away from the plane of the bottom wall 232. The lock spring 229 in the bottom 222 has its locking edge 238 in the form of the lock finger 240 which extend inwardly therefrom toward the interior of the hollow handle 220. When an auxiliary tool 231(e.g. 231A) is to be opened, it is moved out of the hollow handle 220 around pivot 230 and its cam surface 232 strikes the lock spring 229 to move the lock spring 229 away from the plane of the bottom wall 222. Continued rotation of the auxiliary tool 231A will permit the lock finger 240 to enter into the lock notch 237 in the form of a lock groove 241 in the auxiliary tool 231A and hold the auxiliary tool 231A in place in its open position. When it is desired to close the auxiliary tool 231A, i.e. move it back into the hollow handle 220, it is necessary for another auxiliary tool 231 (e.g. 231 B) to be at least partially opened so that its cam surface 232 will strike and move the lock spring 229 away from the first auxiliary tool 231A and move its lock finger 240 out of the lock groove 241 in auxiliary tool 231A so as to release the auxiliary tool 231A for continued movement and nesting within the hollow handle 220.

Figure 25:
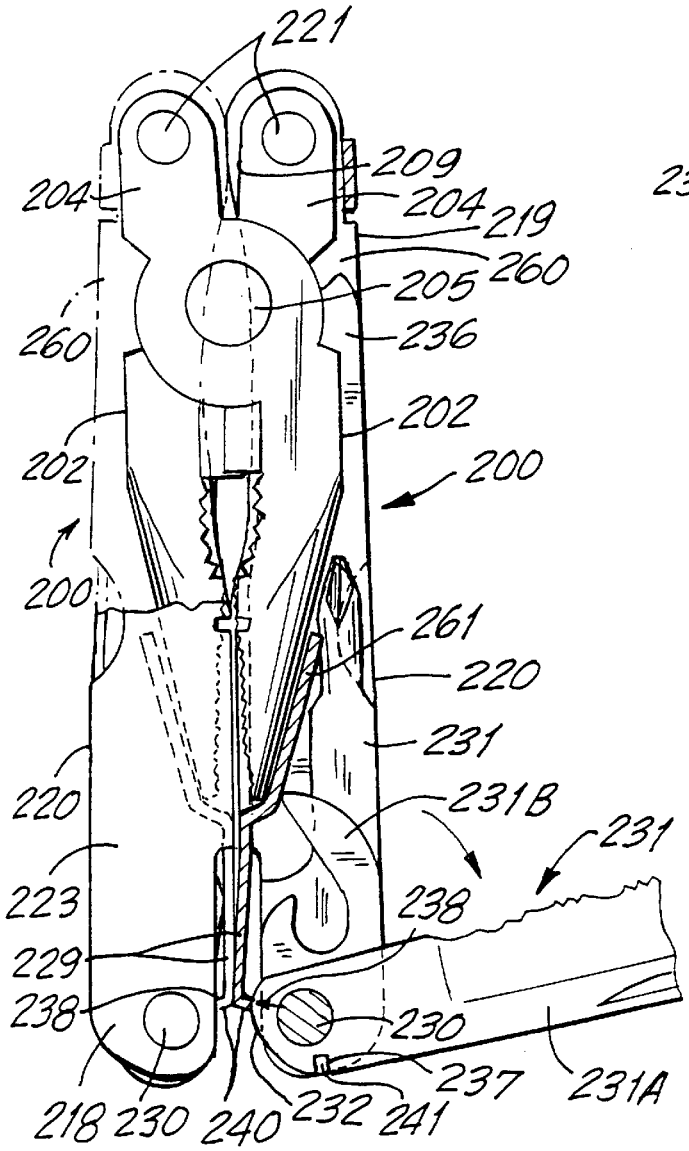
FIG. 25 is a plan view, partly in section, showing the manner of opening an auxiliary tool.
Figure 26B:
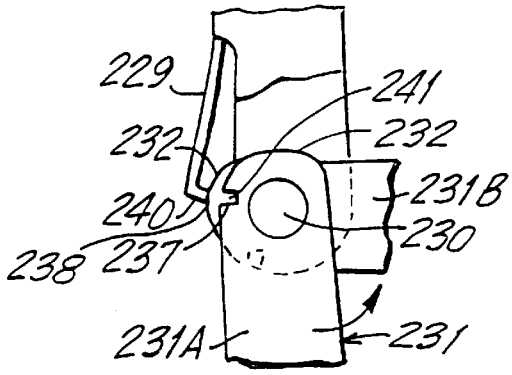
FIG. 26B is a detail view similar to FIG. 26A showing the auxiliary tool in the process of being closed.
Figure 26A:
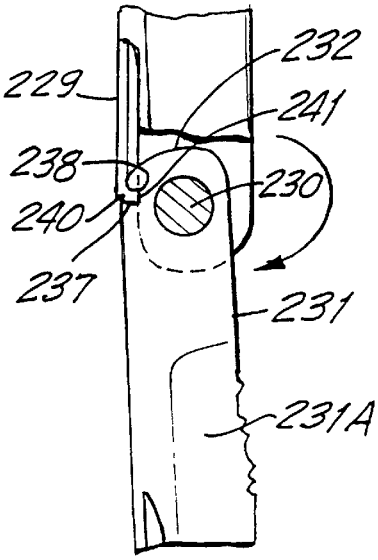
FIG. 26A is a detail view showing the auxiliary tool in its open position.

The folding and unfolding of the tool 200 is substantially similar to the folding and the unfolding of the tools shown in embodiments of 1–8 and 9–17. The hollow handles 220 are folded and the jaws 202 enter the hollow handles 220 through the opening 260 in the bottom wall 222 and nest in the space 236 in the hollow handles 220. The jaws 202 will rest on the depressed tongues 261 in the hollow handles 220, as best seen in FIG. 25, and the spring 210 will be stretched by striking the edges of the shanks 204. A bar 250 may be provided on handles 220 to prevent further unfolding of the handles 220. It will be noted that in this embodiment open tops 217 of the hollow handles 220 face outwardly when the tool 200 is folded but will face toward each other when the tool 200 is unfolded. This permits the auxiliary tools 231 to be opened and used when the tool 200 is in its folded position.

It will thus be seen that the present invention provides an improved foldable hand tool which is simple to use, which may be easily folded and unfolded, in which the various auxiliary tools can be easily opened and closed and which is simple and inexpensive to manufacture and assemble.

As many and varied modifications of the subject matter of this invention will become apparent to those skilled in the art from the detailed description given hereinabove, it will be understood that the present invention is limited only as provided in the claims appended hereto.

What is claimed is:

1. A foldable hand tool comprising a pair of jaws pivoted to each other on a pivot pin, each jaw having a head and a shank, each of said shanks having an inner surface, a one piece coil spring mounted between the shanks of the jaws and attached to each of the inner surfaces of said shanks at a predetermined point on the inner surface of each shank, said coil spring having a pair of opposed ends with each end mounted at said predetermined point on the inner surface of each shank, said coil spring adapted to be stretched when the jaws are folded relative to said handles, said coil spring is adapted to keep the jaws in at least a partially open position, a hollow handle pivotally mounted on a pivot pin located at one end to each of said shanks and foldable relative to said jaws, said pivot arid said predetermined point being spaced from each other, said hollow handle having a plurality of auxiliary tools pivotally mounted therewithin, said auxiliary tools being pivotally mounted on a pivot pin at the other end of said hallow handle, said hallow handle comprising opposed side walls, a bottom wall and an open top, the interior of said hollow handle forming a space to receive at least a portion of said jaws when the hollow handles are folded relative to the jaws, each side wall having an outer surface comprised of upper, lower and end edges, said upper edges terminating at said open top, said lower edges terminating at said bottom wall, a raised finger grip pad provided along an outer surface of each side wall of each handle, said finger grip pad being located wholly within the edges of said side wall, extending no further than the edges of said side wall and terminating within the confines of to said side wall.

* * * * *